US011130550B2

(12) United States Patent
Curtis

(10) Patent No.: US 11,130,550 B2
(45) Date of Patent: Sep. 28, 2021

(54) BRIDGE ERECTION BOAT FOLDING MAST

(71) Applicant: Birdon (UK) Limited, Buckingham (GB)

(72) Inventor: Timothy Curtis, Denver, CO (US)

(73) Assignee: UNIVERSITY OF LOUISIANA AT LAFAYETTE, Lafayette, LA (US)

( * ) Notice: Subject to any disclaimer, the term of this patent is extended or adjusted under 35 U.S.C. 154(b) by 306 days.

(21) Appl. No.: 16/303,907

(22) PCT Filed: Jun. 21, 2017

(86) PCT No.: PCT/US2017/038477

§ 371 (c)(1),
(2) Date: Nov. 21, 2018

(87) PCT Pub. No.: WO2018/005186

PCT Pub. Date: Jan. 4, 2018

(65) Prior Publication Data

US 2020/0317296 A1 Oct. 8, 2020

Related U.S. Application Data

(60) Provisional application No. 62/379,394, filed on Aug. 25, 2016.

(30) Foreign Application Priority Data

Jun. 30, 2016 (GB) ..... 1611515

(51) Int. Cl.

| | |
|---|---|
| ***B63B 15/02*** | (2006.01) |
| ***B63B 45/04*** | (2006.01) |
| *B63B 15/00* | (2006.01) |

(52) U.S. Cl.
CPC ..... *B63B 15/02* (2013.01); *B63B 45/04* (2013.01); *B63B 2015/005* (2013.01)

(58) Field of Classification Search
CPC .... B63B 15/02; B63B 45/04; B63B 2015/005
See application file for complete search history.

(56) References Cited

U.S. PATENT DOCUMENTS 4,537,100 A * 8/1985 Palm ..... B25B 23/0035 403/325
2007/0095267 A1* 5/2007 Tostevin ..... B63H 9/06 114/90

(Continued)

FOREIGN PATENT DOCUMENTS

| | | |
|---|---|---|
| DE | 29603810 U1 | 7/1996 |
| EP | 2031155 A2 | 3/2009 |
| GB | 2124832 A | 2/1984 |

*Primary Examiner* — Stephen P Avila
(74) *Attorney, Agent, or Firm* — Robert D. Ricci; Lauren Rucinski; Kean Miller, LLP

(57) ABSTRACT

The device disclosed herein is for a folding mast device for use on watercraft. In the preferred embodiment, the mast is used on a bridge erection boat; however, additional watercraft may also incorporate this device. The mast includes clamps and other components in order to allow the mast to be assembled and disassembled without tools, which also makes the assembly and disassembly quick. The mast is also quickly removable and replaceable. The mast also can incorporate safety features, such as lighting and other devices needed for safe navigation, and is capable of adjusting to accommodate fabrication differences.

14 Claims, 4 Drawing Sheets

(56) References Cited

U.S. PATENT DOCUMENTS

| | | | |
|---|---|---|---|
| 2015/0132044 | A1 | 5/2015 | Tylaska |
| 2016/0131279 | A1 | 5/2016 | Kemp et al. |

* cited by examiner

BRIDGE ERECTION BOAT FOLDING MAST

CROSS REFERENCE TO RELATED APPLICATION

This application is the National Stage of International Application No. PCT/US2017/038477, filed Jun. 21, 2017, which claims the benefit of U.S. Patent Application Ser. No. 62/379,394, filed Aug. 25, 2016. This application also claims priority to the United Kingdom patent application No. 1611515.6 entitled "Folding Mast System for Watercraft", filed on Jun. 30, 2016.

STATEMENT REGARDING FEDERALLY SPONSORED RESEARCH OR DEVELOPMENT

Not applicable.

Reference to a "Sequence Listing", a Table, or Computer Program

Not applicable.

DESCRIPTION OF THE DRAWINGS

The drawings constitute a part of this specification and include exemplary examples of the BRIDGE ERECTION BOAT FOLDING MAST, which may take the form of multiple embodiments. It is to be understood that in some instances, various aspects of the invention may be shown exaggerated or enlarged to facilitate an understanding of the invention. Therefore, drawings may not be to scale.

FIELD OF THE INVENTION

Figure 1:
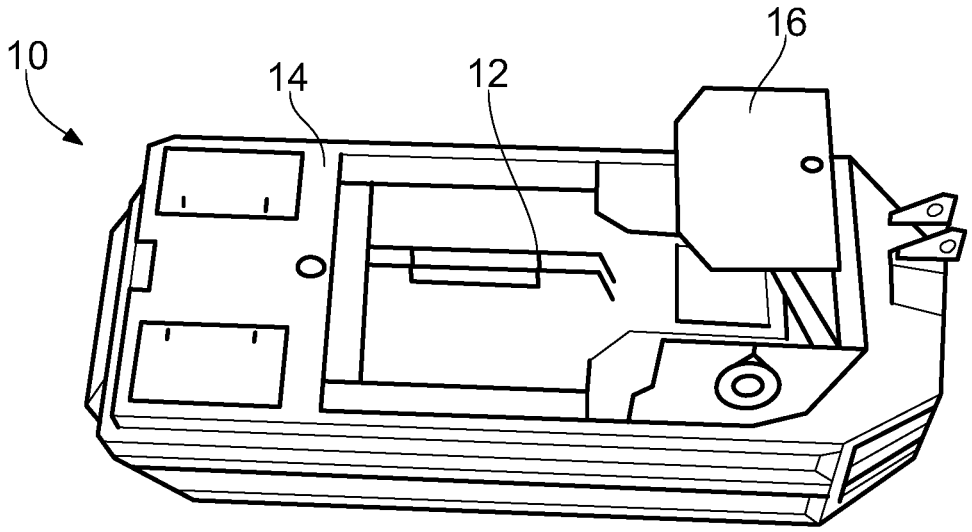
FIG. 1 provides an overhead view of a bridge erection boat with the disclosed folding mast showed in the stowed position.

The subject matter of the present invention generally relates to the field of folding mast systems that may be used to fly a flag, mount navigation lights, or raise safety equipment on a watercraft.

BACKGROUND

When operating bridge erection boats, it is common for a flag to be flown from the mast of the boat. It is also common to install lighting and other safety and navigational devices on the mast. Current mast technology for bridge erection boats typically consist of a single piece fold-down mast. This configuration blocks access to critical boat functionality when stowed and not in use. For bridge erection boats, the single-piece mast blocks the engine hatch and waterjet hatch and blocks use of the main capstan. For some operations, the mast must be removed entirely in order to prevent obstruction of the use.

SUMMARY OF THE INVENTION

The device disclosed herein is for a folding mast device for use on watercraft or other applications. The disclosed mast includes clamps and other components in order to allow the mast to be assembled and disassembled without tools and is capable of bi-folding to permit stowage on deck without obstructing the vessels functionality. The mast hinge is toleranced loosely to allow the two mast pole pieces to come together with sufficient slop to permit alignment. In the preferred embodiment, the mast has conical male and female sockets that align to center the two mast sections on one another and also carry the shear loading. A clamp is then installed around two conical flanges, and as the clamp is tightened, the flanges draw together and finalize centering. Finally, a backup safety locking pin is installed in the hinge to prevent accidental mast collapse. All of the clamps and mast features are designed to permit quick operation without requiring any tools.

DETAILED DESCRIPTION

The subject matter of the present invention is described with specificity herein to meet statutory requirements. However, the description itself is not intended to necessarily limit the scope of the claims. Rather, the claimed subject matter might be embodied in other ways to include different steps or combinations of steps similar to the ones described in this document, in conjunction with other present or future technologies. Furthermore, the described features, structures, or characteristics may be combined in any suitable manner into one or more embodiments.

The device disclosed herein is for a folding mast device for use on watercraft. In the preferred embodiment, the folding mast system is used on a bridge erection boat; however, additional watercraft may also incorporate this device. The folding mast system includes clamps and other components in order to allow the mast to be assembled and disassembled without tools, which also makes the assembly and disassembly quick. The folding mast system is also quickly removable and replaceable. The mast also can incorporate safety features, such as lighting and other devices needed for safe navigation, and is capable of adjusting to accommodate fabrication differences.

As shown in FIG. 1, a watercraft in the form of a bridge erection boat 10 comprises the folding mast system 12. In the preferred embodiment, the folding mast system 12 is disposed on the deck 14 of the boat 10 abaft a wheel house 16. The folding mast system 12 is shown in a folded (or stowed) position.

As shown in FIGS. 2 through 5 and 7, the folding mast system 12 comprises two mast pole pieces 18 and 20 that may be folded for storage (as seen in FIG. 1) or erected to define a mast as shown in FIGS. 2 through 5. When erected, the two mast pole pieces 18 and 20 are aligned and clamped to one another by a centering clamp 22. The adjacent ends of the two mast pole pieces 18 and 20 may be provided with cooperably engageable mating parts to align and center the mast pole pieces. In one embodiment, mast pole piece 18 may have a conical female end part 69 while mast pole piece 20 may have a conical male end part 70 that is cooperably engageable with the female end part 69 of mast pole piece 18.

Figure 3:
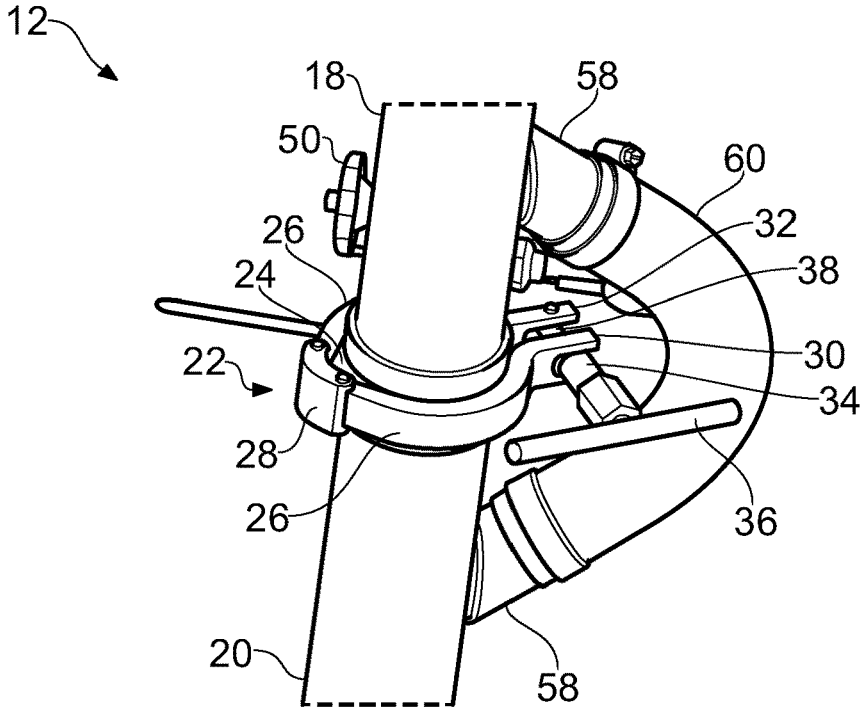
FIG. 3 depicts the clamp of the folding mast system. This secure multi-axis clamping system is unique in that the mast can be erected without tools.
Figure 4:
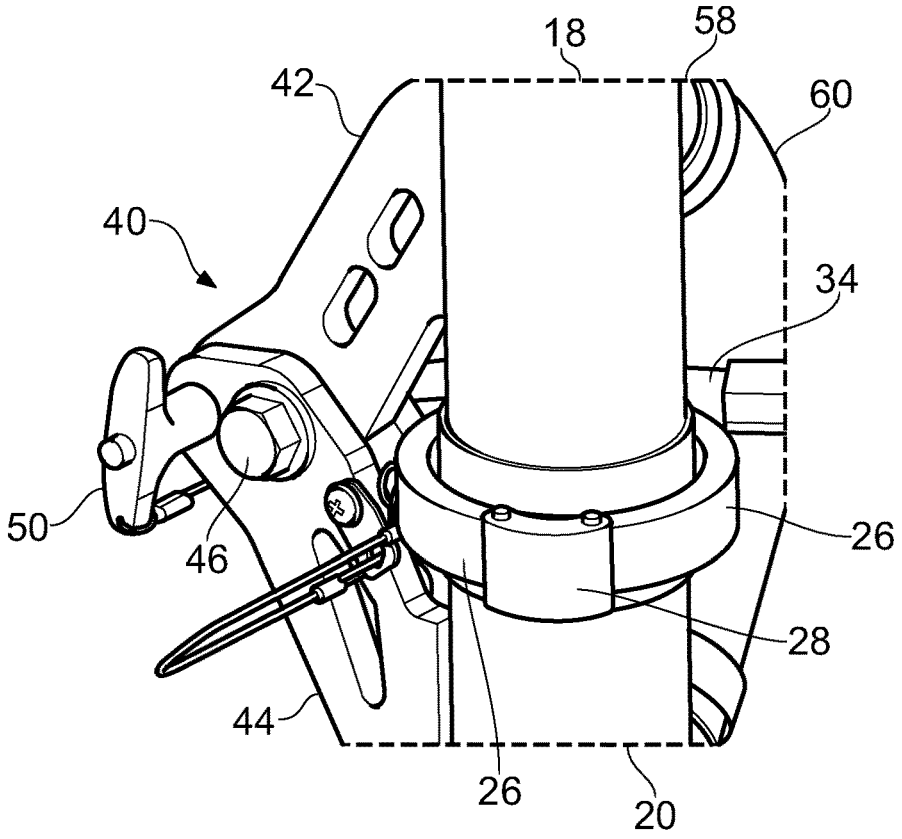
FIG. 4 depicts a hinge and auxiliary safety pin component of the folding mast system. This backup safety pin can support the top half of the mast without the clamp installed during operations.
Figure 7:
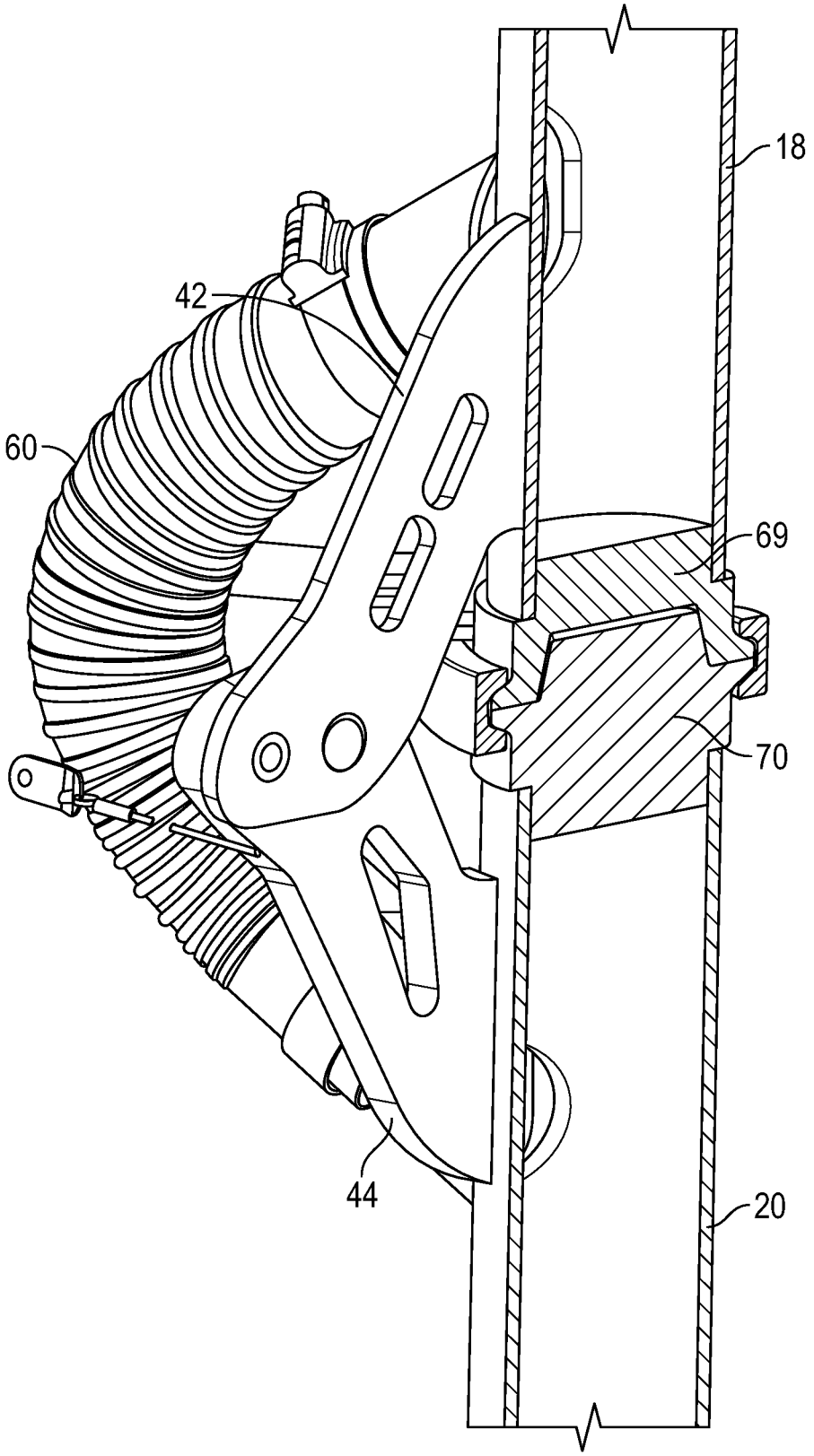
FIG. 7 provides a cutaway view of the clamp of the folding mast system depicted in FIG. 3.

Looking to FIGS. 3, 4 and 7, the adjacent ends of the two mast pole pieces 18 and 20 may be provided with respective flanges. A part of the flange 24 of the upper mast pole piece 18 can be seen in FIG. 3. In an additional embodiment, the flanges may be configured to mate with a groove defined by the centering clamp 22. The flanges may comprise oppositely directed tapering, or conical, major surfaces. The mating of the flanges and centering clamp 22 may assist in providing a stable connection and in locating the clamp while it is being tightened to secure the connection between the mast pole pieces 18 and 20. The centering clamp 22 may comprise two acute arms 26 pivot connected to respective ends of a link 28. The ends 30 and 32 of the centering clamp 22 disposed remote from the link 28 are bent radially outward with respect to the center of the clamp such that when the clamp is closed about the mast pole pieces 18 and 20 they are disposed in generally parallel spaced apart relation. The centering clamp 22 may further comprise a tightening screw 34 that may be provided with a T-bar 36. The tightening screw 34 is rotatably mounted to the end 30 and can be screwed into a nut 38 pivotally mounted to end 32.

Referring to FIG. 4, the mast pole pieces 18 and 20 are hinge connected by a hinge 40. The hinge 40 may be a clevis-type hinge comprising an arm 42 secured to the upper mast pole 18, a bifurcated member 44 secured to a lower mast pole 20 and a pivot pin 46 connecting the arm with the bifurcated member. The hinge 40 may comprise a safety locking pin 50.

Figure 5:
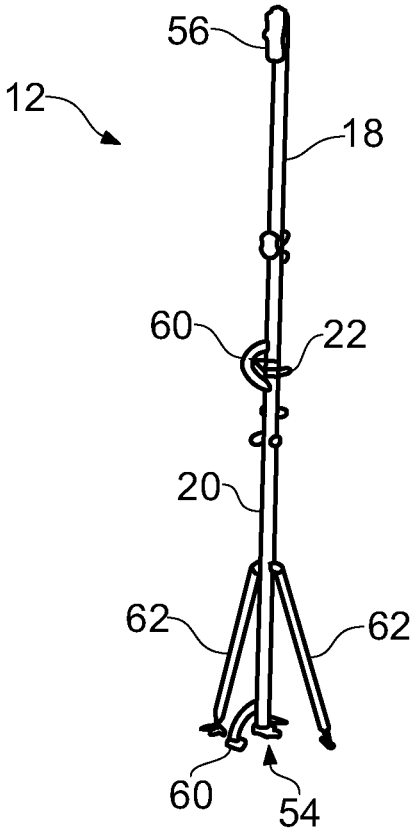
FIG. 5 depicts the adjustable stays of the folding mast in a deployed condition. These stays allow tensioning of the mast, accommodates fabrication differences, and compensates for wear over time.

Referring to FIG. 5, the lower end of the lower mast pole piece 20 may be provided with a mast base comprising a flange provided with a part shaped to mate with a cooperable deck fitting that is secured to the deck 10 of the bridge erection boat 10. In the preferred embodiment depicted in cutaway view at FIG. 7, the mating parts are female 69 and male 70 conical parts and the mast base may be secured to the deck fitting by means of a centering clamp the same as, or similar to, the centering clamp 22.

Figure 2:
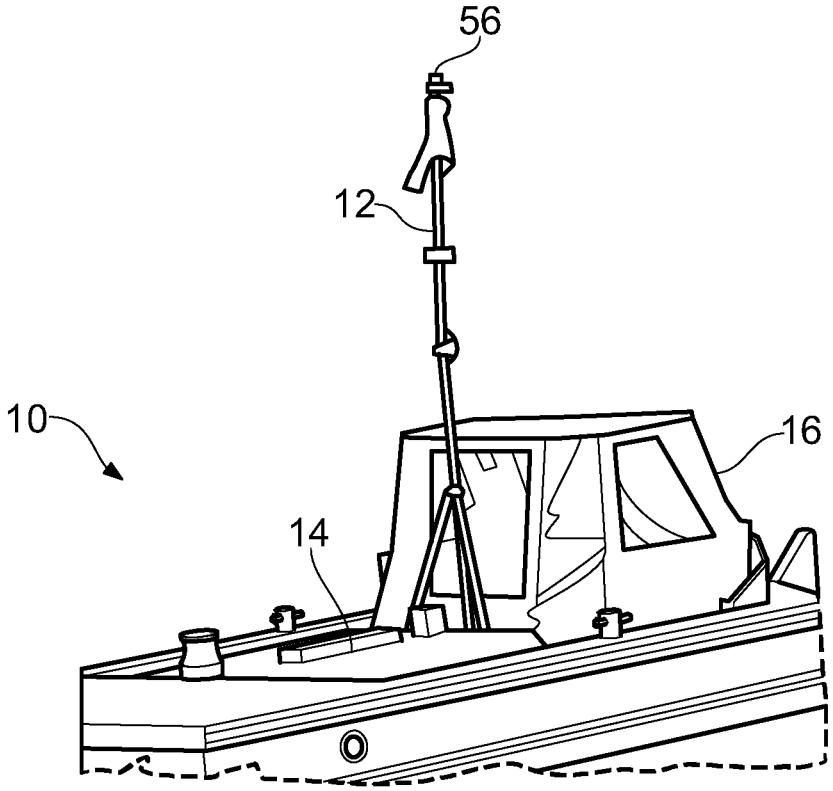
FIG. 2 provides a view of the disclosed folding mast shown in the raised position.

In an additional embodiment, the upper mast pole piece 20 comprises lighting 56, shown in FIGS. 2 and 5. The mast pole pieces 18 and 22 may be hollow so that lighting 56 can be supplied with electrical power conducted by wiring extending through the hollow interior of the mast. Ports may be provided at the ends of the mast pole pieces 18 and 20 to allow entry and exit of the wiring. As seen in FIG. 3, the ports 58 may be formed by tubular projections protruding from the mast pole pieces 18 and 20. The ports 58 may be connected by means of flexible tubing or bellows 60 through which the wiring passes between the adjacent ends of the mast pole pieces 18 and 20.

The folding mast system is capable of bi-folding to permit stowage on deck without obstructing the vessel's functionality. This is made possible by the hinge 40 on the mast and the centering clamp 22. The mast hinge 40 is tolerance loosely to allow the two mast pole pieces 18 and 20 to come together with sufficient slop to permit alignment. The mast pole pieces 18 and 20 have conical male 70 and female 69 portions configured to align and center the two mast pole pieces on one another and also carry the shear loading. The centering clamp 22 is installed around the two mast pole piece flanges, and as the clamp is tightened, the flanges draw together and finalize the centering. Finally, a backup safety locking pin 50 is installed in the hinge to prevent accidental mast collapse. The centering clamp 22 and hinge 40 are designed to permit quick operation without requiring any tools.

A similar flange and centering clamp arrangement may be provided for securing the mast base to a deck fitting to hold the mast erect. The entire mast can quickly be removed from the vessel by removing the lower pivot point and unplugging the electrical connection.

The safety pin 50 between the mast pole pieces 18 and 20 is designed to support the upper mast pole piece without the use of the centering clamp 22 and prevent the upper mast pole piece from falling down in the event the centering clamp is not installed correctly.

The upper mast pole piece can be folded when the lower mast pole piece is erected. This is particularly useful for when the vessel has to operate underneath a low bridge, but the mast needs to be quickly returned to operational state once clear of the bridge.

Figure 6:
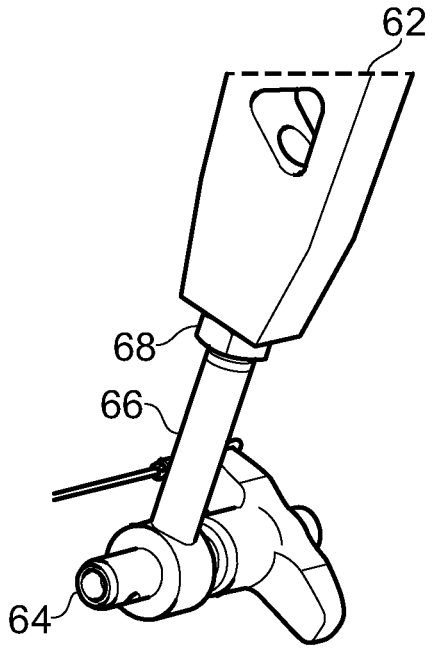
FIG. 6 provides an enlarged viewing of the adjustable stays depicted in FIG. 5.

As seen in FIGS. 5 and 6, two adjustable stays 62 may be used to add additional support and stability to the mast to minimize whipping. The stays 62 pivot on the lower mast pole piece 20 from a stowed position to interface with the padeyes on the deck 14. In the preferred embodiment, the stays 62 are clipped in place using respective quick release pins 64. The length of the stays 62 can be adjusted by screwing in or unscrewing the eye 66 to which the quick release pin 64 is fitted and then tightening the jam nut 68 once in the correct location. This accommodates for fabrication differences, wear and tear on system and allows mast in tension to be maintained at all times.

The mast may be fabricated from lightweight aluminum and may be fitted with navigation lights, towing lights, anchoring lights, and other features such as strobe lights required for safe operation. Electric wire and cables are run through the ports 58 and flexible bellows 60 for weather protection and water tightness such that they are not affected by the folding or clamping mechanism.

The preferred embodiment of a folding mast system 12 has two mast pole pieces 18 and 20. Additional embodiments may have three or more mast pole pieces provided with respective centering clamp and hinge arrangements the same as or similar to those shown in FIGS. 3 and 4 to connect and clamp adjacent mast pole pieces to one another.

While the folding mast system was designed for use on watercraft, the features and advantages of this design described in this application can be utilized by a number of different industries.

The described features, advantages and characteristics of the folding mast system may be combined in any suitable manner in one or more embodiments. One skilled in the relevant art will recognize that the various components of the preferred embodiment may be practiced with one or more of the specific features or advantages in other embodiments. In other instances, additional features and advantages may be recognized in certain embodiments that may not be present in all embodiments.

Reference throughout this specification to "one embodiment", "an embodiment", or similar language means that a particular feature, structure, or characteristic described in connection with the embodiment is included in at least one embodiment. Thus the appearance of the phrase "in one embodiment", "in an embodiment", and similar language throughout this specification may, but do not necessarily, all refer to the same embodiment.

I claim:

1. A folding mast system comprising:

(a) at least two mast pole pieces erectable to define a mast;

(b) a mast hinge;

(c) a centering clamp;

(d) a mast base, wherein said mast base is disposed at a base end of one of said mast pole pieces and is configured to mate with a fitting provided on a deck of watercraft;

(e) a safety locking pin; and (f) at least two adjustable stays to connect with the deck of a watercraft when the mast is in an erected position;

(g) fitting, wherein one of said mast base and said fitting compromises a conical female part and the other of said mast base and said fitting comprises a mating male part; wherein the mast pole pieces are connected at the mast hinge and when, in use, the mast is erected, the mast pole pieces are centrally aligned and the centering clamp is installed around and clamps the connection between the two mast pole pieces.

2. The folding mast system of claim 1, wherein:

one of said mast pole pieces has a conical male end part;

another of said mast pole pieces has a conical female end part cooperably engageable with said male end part to align and center said two mast pole pieces; and the centering clamp is configured to clamp around the engaging end parts when said mast is in an erected position.

3. The folding mast system of claim 1, wherein said mast pole pieces are hollow.

4. The folding mast system of claim 3, wherein the interior of said mast pole pieces is watertight.

5. The folding mast system of claim 3, further comprising safety lighting.

6. The folding mast system of claim 4, further comprising safety lighting, wherein electrical wire to conduct power to the safety lighting is run through the hollow mast pole pieces.

7. The folding mast system of claim 6, wherein said electrical wire is run between the mast pole pieces through ports and flexible bellows.

8. The folding mast system of claim 1, wherein said adjustable stays are pivotally connected with said mast pole piece to allow relative pivoting movement when the mast is erected from a folded position.

9. The folding mast system of claim 1, wherein said adjustable stays are configured to interface with the padeyes on the deck of the watercraft.

10. The folding mast system of claim 9, wherein the adjustable stays are confirmed to be clipped into place on the watercraft deck using quick release pins.

11. A folding mast system comprising:

(a) at least two mast pole pieces erectable to define a mast, wherein: one of said mast pole pieces has a conical male end part; another of said mast pole pieces has a conical female end part cooperably engageable with said male end part to align and center said two mast pole pieces; said mast pole pieces are hollow; and the interior of said mast pole pieces is watertight;

(b) safety lighting, wherein:

electrical wire to conduct power to the safety lighting is run through the hollow mast pole pieces; and said electrical wire is run between the mast pole pieces through ports and flexible bellows;

(c) a mast hinge;

(d) a centering clamp, wherein the centering clamp is configured to clamp around the engaging end parts of the mast pole pieces when said mast is in an erected position;

(e) a mast base, wherein said mast base is disposed at a base end of one of said mast pole pieces and is configured to mate with a fitting provided on a deck of watercraft;

(f) a safety locking pin; and (g) at least two adjustable stays to connect with the deck of a watercraft when the mast is in an erected position; wherein the mast pole pieces are connected at the mast hinge and when, in use, the mast is erected, the mast pole pieces are centrally aligned and the centering clamp is installed around and clamps the connection between the two mast pole pieces; and wherein one of said mast base and said fitting compromises a conical female part and the other of said mast base and said fitting comprises a mating male part.

12. The folding mast system of claim 11, wherein said adjustable stays are pivotally connected with said mast pole piece to allow relative pivoting movement when the mast is erected from a folded position.

13. The folding mast system of claim 11, wherein said adjustable stays are configured to interface with the padeyes on the deck of the watercraft.

14. The folding mast system of claim 13, wherein the adjustable stays are confirmed to be clipped into place on the watercraft deck using quick release pins.

* * * * *